US010408448B2

(12) United States Patent
Garg

(10) Patent No.: US 10,408,448 B2
(45) Date of Patent: Sep. 10, 2019

(54) DAMPER SYSTEM FOR HEATER STACK

(71) Applicant: Ashutosh Garg, Sugar Land, TX (US)

(72) Inventor: Ashutosh Garg, Sugar Land, TX (US)

( * ) Notice: Subject to any disclaimer, the term of this patent is extended or adjusted under 35 U.S.C. 154(b) by 677 days.

(21) Appl. No.: 14/990,256

(22) Filed: Jan. 7, 2016

(65) Prior Publication Data

US 2017/0198910 A1 Jul. 13, 2017

(51) Int. Cl.

*F23L 13/02* (2006.01)
*F23L 13/08* (2006.01)
*F23L 17/00* (2006.01)

(52) U.S. Cl.

CPC ..... *F23L 13/02* (2013.01); *F23L 13/08* (2013.01); *F23L 17/00* (2013.01)

(58) Field of Classification Search

CPC . F23L 13/02; F23L 13/04; F23L 13/08; F23L 17/00

See application file for complete search history.

(56) References Cited

U.S. PATENT DOCUMENTS 273,716 A * 3/1883 Evans ..... F23L 13/02 126/292
522,521 A * 7/1894 Hermance ..... F23L 13/02 126/292
593,930 A * 11/1897 Fraser ..... F23L 13/00 126/296
654,045 A * 7/1900 Anderson ..... F23L 13/02 126/292
677,572 A * 7/1901 Hoepfner ..... F23L 13/02 126/292
1,710,790 A * 4/1929 Soubier ..... C03B 7/04 65/340
2,116,648 A * 5/1938 Tapley ..... F23L 13/02 126/296
4,232,595 A * 11/1980 Cox ..... F23L 17/02 110/184
4,237,855 A * 12/1980 Shea ..... F23L 11/005 126/285 B
4,341,344 A * 7/1982 Russell ..... F23L 11/02 110/163
4,422,440 A * 12/1983 Russell ..... F23L 11/02 110/163
4,425,855 A * 1/1984 Chadshay ..... F23C 5/32 110/106
4,494,485 A * 1/1985 Kendall ..... C10G 9/20 122/250 R (Continued)

FOREIGN PATENT DOCUMENTS

GB 190328713 A * 12/1904
GB 2531304 A * 4/2016 ..... F23L 13/02

*Primary Examiner* — Kenneth Rinehart
*Assistant Examiner* — Logan P Jones
(74) *Attorney, Agent, or Firm* — John R. Casperson

(57) ABSTRACT

In a stack leading from a fired heater, a plurality of damper blades are positioned at a longitudinal location, each blade being at least partly rotatable around its longitudinal axis to regulate flow through the stack. A plurality of controllers is operatively associated with the plurality of parallel blades to effect rotation of the blades. At least one of the controllers is decoupled from the rest of the plurality of controllers and used to independently control at least one but not all of the plurality of damper blades. The damper blades can be parallel or opposed.

1 Claim, 3 Drawing Sheets

(56) References Cited

U.S. PATENT DOCUMENTS

| | | | | |
|---|---|---|---|---|
| 6,520,848 | B1 * | 2/2003 | Grant | F23L 13/02<br>110/184 |
| 6,868,806 | B1 * | 3/2005 | Schimmeyer | F23L 11/005<br>122/135.1 |
| 2008/0098967 | A1 * | 5/2008 | Garg | F22B 21/343<br>122/155.1 |
| 2011/0203569 | A1 * | 8/2011 | Weimer | F23J 11/02<br>126/285 B |

* cited by examiner

DAMPER SYSTEM FOR HEATER STACK

FIELD OF THE INVENTION

The invention relates to dampers for heater stacks and using the dampers to control draft and improve efficiency.

BACKGROUND OF THE INVENTION

Petroleum refining is the most energy intensive industry in the USA and accounts for 7.5% of the total energy consumption in the country. Total energy costs are on the order of $20 billion dollars per year, although a large portion of the required energy is produced internally. The situation is very similar in the petrochemical and fertilizer Industry.

Fired heaters are major consumers of energy in the refining and petrochemical industries. Almost 40 to 70% of the total energy consumption in a refinery or petrochemical plants is in fired heaters. While most of the heaters are designed for a thermal efficiency of 70-90%, the actual operating efficiencies are much lower.

While most of the plant operators are aware of the importance of controlling excess oxygen in the fired heaters, draft control in fired heaters is often overlooked. A recent survey carried out indicated that the average draft in the fired heaters is maintained at almost 3-4 times the value recommended. This type of operation causes considerable loss of energy. Current stack dampers are not capable of controlling draft properly and do not work reliably. Most of the dampers are manually operated. Even the pneumatically operated dampers are not designed correctly to control the draft, especially when the heater is operating at reduced conditions. The operators are scared to close the dampers and reduce the excess draft in the heater.

For a 100,000-barrel-per-day (BPD) refinery, even 2-3% improvement in thermal efficiency for the fired heaters translates into energy savings of almost 2.5 million dollars per year.

OBJECTS OF THE INVENTION

It is an object of this invention to provide an improvement in thermal efficiency for fired heaters.

It is another object of this invention to provide a fired heater with an improved damper and draft control.

DETAILED DESCRIPTION OF THE INVENTION

The invention is described with reference to cabin heaters, but it applies to all other types of heaters that employ a stack with damper as well, for example, vertical cylindrical, box, arbor, and fired heaters that use induced draft fans as well. It also applies to heaters having long convection sections or multiple convection section with off take ducts that connect the convection sections to the stack.

Figure 1:
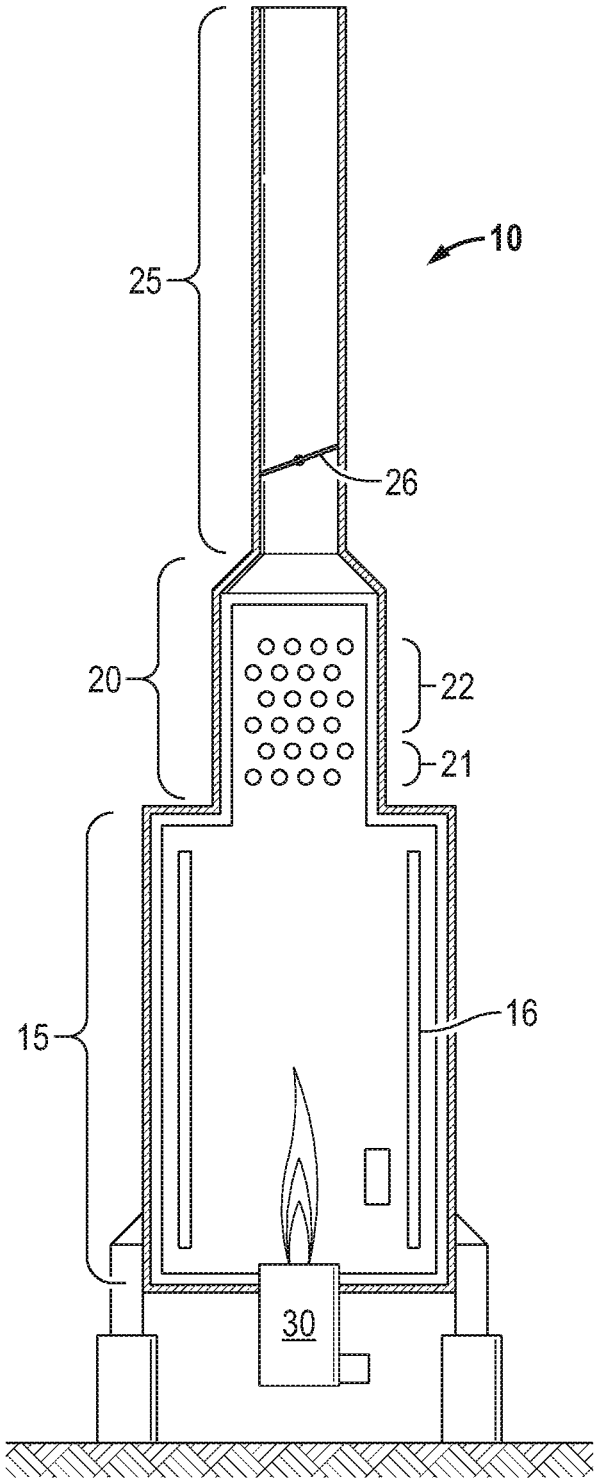
FIG. 1 (Prior Art)
FIG. 1 is a schematic of a fired heater according to the prior art.
Figure 2:
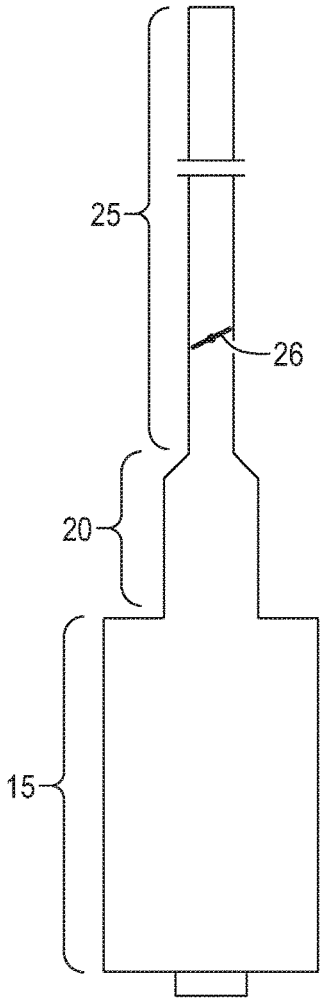
FIG. 2 (Prior Art)
FIG. 2 is another schematic of a heater according to the prior art in juxtaposition to FIG. 3, showing its pressure profile.

A typical fired heater 10 according to the prior art is shown cross-sectionally in FIG. 1. The heater consists of three major components: a radiant section 15, a convection section 20 and a stack 25. Radiant section 15 contains fired tubes 16. Convection section 20 contains guard tubes 21 and finned tubes 22. The fired heater is fired using oil or gas as a fuel. The fluid carried in the tubes absorbs the heat mostly by radiant heat transfer and convective heat transfer from the flue gases. The flue gases are vented to the atmosphere through the stack. Draft is controlled by damper 26 in the stack. Burners 30 are located on the floor or on the sidewalls. Combustion air is drawn from the atmosphere. Combustion conditions are directly affected by the draft.

Burners start and maintain combustion in the firebox. They introduce fuel and air in the correct proportions, mix the fuel gas and air, provide a source of ignition, and stabilize the flame. Most of the burners in fired heaters are natural draft. They are the ones which are most dependent on the draft. All natural draft burners are sized for a specific draft loss across the burner. Providing higher draft than design will induce more air and providing lower draft will lead to insufficient air for combustion. In most cases, the operators leave the stack fully open and as a result the burner operates under very high draft. While operators can control excess O2 by adjusting burner registers, they are not able to control the air leakage due to high draft inside the furnace. Stacks are being sized for pollutant ground level dispersion concentration and not for draft. They are much taller and this produces very high draft. The taller the stack, the greater the draft available.

Draft has many meanings, but in our case refers to the air or flue gas pressure that is slightly negative with respect to the atmospheric pressure. The hot flue gases inside the firebox and stack are lighter than the cold ambient air outside. This results in the creation of a slightly negative pressure inside the fired heater. Combustion air is drawn into the burners from the atmosphere and the hot gas flows out of the stack to the atmosphere due to this pressure differential. In natural draft heaters, draft control is the most important parameter for efficient operation.

While passing through the convection section and stack, flue gases encounter friction resistance and these are known as draft losses. Sufficient stack height is provided to overcome these losses and to ensure that pressure is always negative inside the firebox. Negative pressure makes the heater inherently safe and at no time the hot flue gases will come out of the fired heater. A positive pressure inside the heater will cause flue gas leakage and damage to the fired heater casing and structure. A positive pressure can also be hazardous to the operating personnel.

Figure 3:
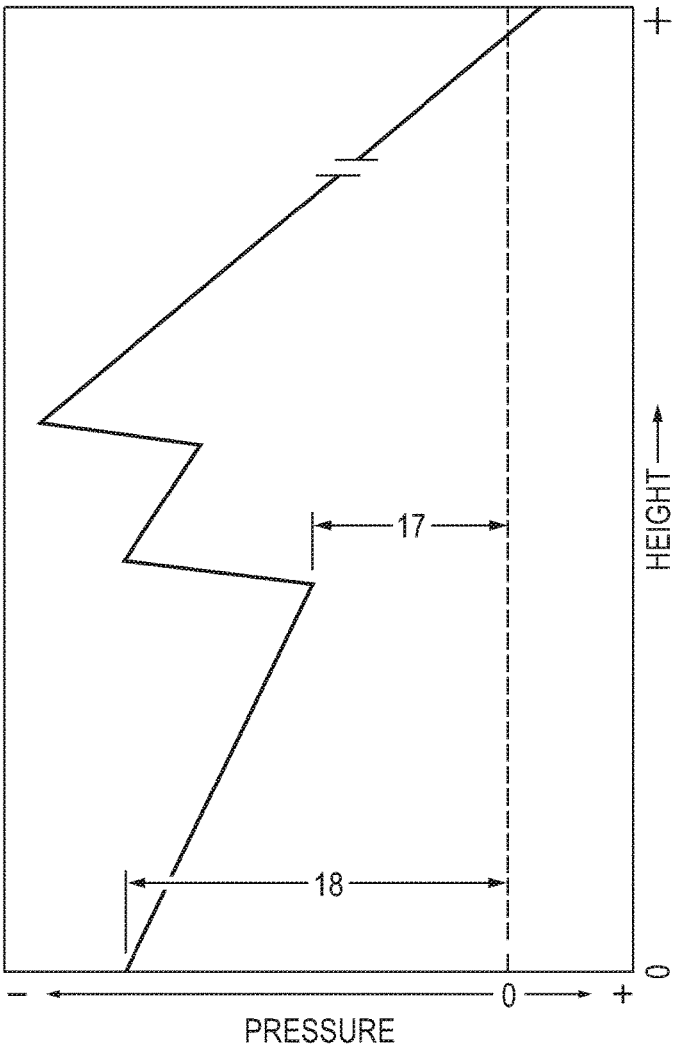
FIG. 3 (Prior Art)
FIG. 3 is a schematic showing a pressure profile for the prior art heater of FIG. 2.

As can be seen from the draft profile shown in FIG. 3, the inlet to the convection section 20 of the heater (the arch) has the highest pressure 17 in absolute terms in the whole heater except the stack tip. If the arch pressure can be controlled to be negative, atmospheric terms, the whole heater will be at negative pressure. The floor of the heater or the hearth where the burners are typically located gain the draft due to the stack effect in the radiant section. Typical draft gains are of the order of 0.1" WG (water gauge) per ten feet of box height in the radiant section. A typical value of heater draft 18 at the floor is of the order of 0.3 inch to 0.7 inch for tall vertical cylindrical heaters. In the convection section, the flue gases encounter resistance due to the tubes but gain some draft due to the convection section height. In case the convection section becomes fouled the pressure drop across the convection section will go up and the heater arch draft can become positive.

Similarly in the stack, the stack damper is provided to control the draft and there is a certain draft loss associated with the damper. If the stack damper is closed too far, the arch draft will become positive and similarly if it opened too far, it will lead to a very high draft in the arch. The required stack height provides the draft required to maintain negative pressure at arch and take care of losses in the convection section and stack.

The arch draft should be kept at a design value of 0.1" water gauge (WG). This will ensure safe operation and minimum air leakage. Excess air needs to be minimized for efficiency improvement. However, sufficient air must be provided to obtain the correct and desirable flame shape and complete combustion. Closing air registers reduces the airflow but increases the heater draft. Closing the stack damper reduces the fired heater draft. In order to adjust excess air, the stack damper must be adjusted in conjunction with the air registers. If the draft at the arch is high that will insure that the draft in the whole heater is higher than required. Since the heater is not a pressure tight structure, it is possible to have air leakage in the heater from all possible openings and leakage points. This air does not take part in the combustion and shows up in the stack. It is wasting energy but it could be leading to sub stochiometric combustion. On the other hand if the draft in the heater is positive, it could lead to the blowing of hot gases from the firebox through the openings and that could pose as a safety hazard.

In order to minimize the air leakage into the heater:

All peepholes must be kept closed.

The header box doors must be tightened to eliminate any air leakage.

Keep the explosion door closed.

Ensure there is minimal air leakage from the tube guide penetrations in the floor.

One of the good indications of air leakage is the production of CO even at high oxygen levels. If the excess O2 is running normal but the CO is running high then it indicates air leakage into the fired heater.

A very important control element for controlling draft is the stack damper. If the stack damper is closed too far, the arch draft will become positive and similarly if it is opened too far, it will lead to a very high draft at the arch. API 560 specifies several requirements for a good stack damper. It requires one blade for every thirteen square feet of internal cross section area. The blades should be of equal area and the movement should be opposed. It also calls for damper controls to be provided with external position indicator and should be designed to move to the position specified by the purchaser in the event of control signal failure or motive force failure. Dampers are provided with 1" clearance all around the damper blades to prevent sticking or fouling with the refractory. This creates almost 7-10% area which is always available.

Figure 4:
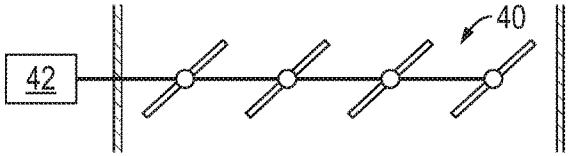
FIG. 4 (Prior Art)
FIG. 4 is a schematic showing a prior art damper assembly for a heater stack.
Figure 5:
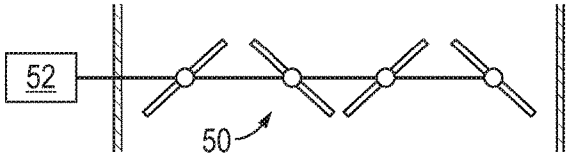
FIG. 5 (Prior Art)
FIG. 5 is a schematic showing a different prior art damper assembly for a heater stack.

Current damper/operator designs employ a single actuator, which may act on multiple blades. See FIGS. 4 and 5. FIG. 4 is an example of a parallel co-rotating blade assembly 40 actuated by a single controller 42. FIG. 5 is an example of a parallel counter rotating blade pair assembly 50 actuated by a single controller 52. Because there is a single operator in these designs, all blades move in unison. The damper in the prior art is typically operated from grade by means of a manual actuator, for example, a cable and a winch. The damper is provided with an external position indicator and the winch is also calibrated. These dampers are of very poor quality and often get stuck and sometime remain fully open.

Operators are scared to touch these dampers and make adjustment to drafts.

The inventive damper/operator designs employ multiple operators, each operator acting on one or more blades. See FIG. 6-9 schematics. Each blade is no larger than 13 sq. ft. and it may be much smaller. Each damper assembly has two or more blades and two or more operators, which are preferably of a type that can be actuated by an electronic controller. For example a suitable operator could comprise a programmable logic controller (PLC) signaling a microcontroller (PIC) signaling a current/pneumatic positioner (I/P) coupled to one or more blades.

Figure 6:
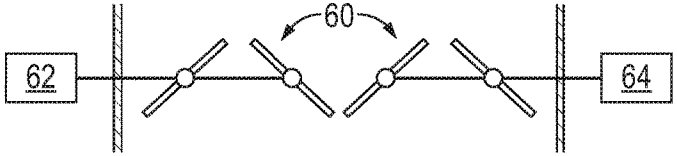
FIG. 6 is a schematic showing a first inventive damper assembly for a heater stack.
Figure 7:
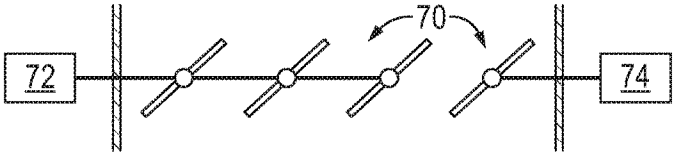
FIG. 7 is a schematic showing a second inventive damper assembly for a heater stack.
Figure 8:
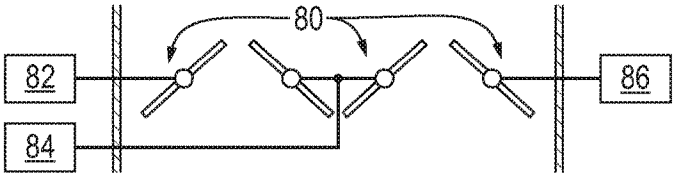
FIG. 8 is a schematic showing a third inventive damper assembly for a heater stack.
Figure 9:
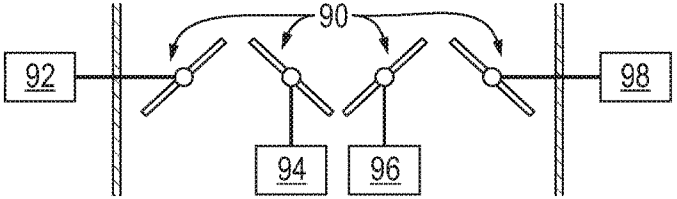
FIG. 9 is a schematic showing a fourth inventive damper assembly for a heater stack.

FIGS. 6-9 schematically illustrate the possibilities for a 4 bladed damper assembly. In FIG. 6, an assembly 60 of two parallel counter rotating blade pairs is actuated by two controllers 62 and 64, one for each pair. In FIG. 7, an assembly 70 of four co-rotating blades is actuated by two controllers 72, 74, three blades and one blade respectively. It expected by the blades actuated by controller 72 will be kept mostly closed. In FIG. 8, an assembly 80 of two parallel counter rotating blade pairs is actuated by three controllers 82, 84, 86, one blade, two blades, and one blade, respectively. It is expected by the blades actuated by controllers 82 and 84 will be kept mostly closed. In FIG. 9, an assembly 90 of two parallel counter rotating blade pairs is actuated by four controllers, 92, 94, 96 and 98, one for each blade.

In most cases, 2 or 3 sets of one-or-more-dampener-blade/operators will be sufficient to control the draft very effectively in most of the heaters. The two or more sets of operator/damper blade subassemblies can be controlled with one set of operator/damper(s) being base loaded or manually set to a fixed position, generally near closed, and the other set(s) of operator/damper blades controlling the draft accurately in the heater.

Stacks typically operate at less than design. Most of the stacks are sized at 120% capacity as per API standards. Even at 100% load operation, the stack damper needs to be partially closed to adjust the draft, and therein lies the problem. Existing dampers need to be mostly closed, 60-70% or more, for optimal operation under normal conditions. The plant owners do not feel comfortable in closing the damper to that extent. Good control range is available over the 30-60% open range and with two operators that is what we will be able to achieve by base loading one set of dampers to near closed position and control with the second set of damper blades. Two or more operators will do this task easily.

Draft depends directly to the ambient temperature. Any variation in the ambient temperature affects the draft availability. The sizing is done at highest ambient temperature. For example, if we have a 30° F. differential between the maximum and minimum temperature during the day, the draft available across the burner will change from 0.30 to 0.35 in WC, a change of almost 20%. This change in draft will lead to more combustion air supplied to the burners, making the operation inefficient. It is very important to maintain a constant draft in the heater at all times.

The inventive designs overcome tricky draft control problems at reduced load operation. At loads lower than design the stack damper needs to be more closed to get the required draft at arch. The current stack dampers are not able to control the draft effectively at a reduced load. The damper needs to be at least 60-70% closed and existing dampers cannot do that job reliably.

The new design has two or more sets of operators and depending upon the load they can both be set at different openings. For a three-bladed damper assembly, at 75% load, one of the three blades can be kept closed. At 30% load, maybe 2 of the 3 blades can be kept closed. For a four-bladed assembly, at 50% operation, one set of damper blades can be kept fully closed and the other set of damper blades can control the draft effectively giving it proper control range. Plant personnel will not be scared to close one damper set fully. At 30% operation, 2 out of the 3 or 3 out of 4 blades can be near fully closed.

The blades of the damper are individually independently controlled, or controlled as independent subsets of the assembly. At reduced flow conditions, some of the blades or subsets of blades can be set to a fully restrictive state with little risk of creating a positive pressure state in the cabin. The remaining blades or subsets of blades can be adjusted manually or automatically in response to arch pressure for best economy at load conditions.

Our mode of operation will be recommending the operator to check the fuel gas firing rate to the heater. That describes very accurately the heater operating conditions. Let us say that he sees the operation at 75% load and sees the draft of 0.4 inch WC (ideal target is 0.1 inch WC). If he has three sets of damper operators, we can tell him to close one set of damper blades fully and use the two sets of blades to control the draft effectively. If he goes down to 50%, then he can close two sets of blades to 70% closed and then operate the draft with the with one set of blades. The heater draft available remains more or less fixed due to the ambient temperature and flue gas temperature. However the friction losses are proportional to the square of the flow. If the heater is operating at 70% load, now the friction losses are also halved. The draft available across the damper keeps on increasing as the load keeps on going down. The damper has to be closed even more to kill the extra draft that becomes available at lower loads. If the draft is not adjusted or controlled, it will create a higher draft in the radiant section and convection section and it will lead to air leakage which will reduce the heater efficiency and even disrupt the combustion control.

We will preferably link our damper operators with the high pressure switch and alarm at the arch. In case of high pressure at the arch, all the damper blades will go fully open and will try to relieve the high arch pressure. In case it is not relieved in 8-10 seconds, the furnace is tripped and fuel is cut off.

The new stack dampers can be easily integrated in the automatic draft control scheme by linking the damper opening to the firing rate.

Other Applications:

A number of cabin heaters with long convection sections have off take ducts. These ducts connect convection sections to the stack. A number of these heaters have multiple off takes connecting the convection section to the stack. Some heaters have the dampers installed in the off takes instead of stack. These dampers are essentially the same type and quality as the previous stack damper. Both the off take dampers should be operated uniformly as to avoid any imbalance that will change the flue gas flow pattern in the furnace. The dampers in the take offs can be replaced with the assemblies described hereinabove.

In several installations, a number of heaters are connected to a common stack. It is very common in the Europe where the local pollution laws dictate using a 200 to 300 ft stack. These stacks are located on the grade and the Fired Heaters are connected through the duct work. In these installations, the draft control becomes even more important. Any change in the firing condition of one heater, changes the draft in all the other heaters calling for adjustment of draft in all these heaters. In such circumstances, it is necessary to have a good stack damper, preferably of the inventive type, and proper, preferably automatic draft control system for each heater.

This concept can be used to modify the existing dampers as well. It can be applied to manually operated dampers as well as pneumatically operated damper. In manually operated dampers we can have 2 or more cable or winches to control 2 or more sets of damper blades independently.

The Combustion Process

Combustion is an exothermic reaction resulting from rapid combination of fuel with oxygen. As a result of combustion, heat is produced along with the formation of flue gases. Fuel and air must be mixed thoroughly for complete combustion. In theory, it is possible to burn fuel completely with just the stoichiometric amount of combustion air. In actual operating conditions, it is not possible to have perfect mixing of fuel and air in short time available for combustion. If a theoretical amount of combustion air is provided than some fuel would not burn completely. Therefore, it becomes necessary to supply excess air to complete combustion of the fuel. Excess air is expressed as a percentage of the theoretical quantity of air required for perfect combustion. This excess air shows up as excess oxygen in the flue gases. Table 1 below gives the effect of excess air on the heater thermal efficiency. As a thumb rule every 10% increase in excess air reduces the heater efficiency by almost 1%.

TABLE 1

| Excess Air | $O_2$ in Flue | Temperature of Flue Gas in F. | | | | | | | | | | |
|---|---|---|---|---|---|---|---|---|---|---|---|---|
| (%) | Gas % | 300 | 350 | 400 | 450 | 500 | 550 | 600 | 700 | 800 | 900 | 1000 |
| 15 | 3.00 | 91.76 | 90.44 | 89.11 | 87.77 | 86.42 | 85.06 | 83.6 | 80.59 | 78.11 | 75.25 | 72.35 |
| 20 | 3.82 | 91.52 | 90.15 | 88.77 | 87.39 | 85.98 | 84.57 | 83.15 | 80.28 | 77.36 | 74.4 | 71.39 |
| 25 | 4.56 | 91.29 | 89.87 | 88.44 | 87.01 | 85.55 | 84.09 | 82.62 | 79.64 | 76.61 | 73.55 | 70.43 |
| 30 | 5.24 | 91.05 | 89.58 | 88.10 | 86.61 | 85.11 | 83.62 | 82.07 | 78.99 | 75.87 | 72.69 | 69.47 |
| 40 | 6.46 | 90.58 | 89.01 | 87.43 | 85.84 | 84.24 | 82.60 | 81.00 | 77.71 | 74.37 | 70.99 | 67.55 |
| 50 | 7.49 | 90.10 | 88.43 | 86.76 | 85.06 | 83.36 | 81.64 | 79.92 | 76.43 | 72.28 | 69.28 | 65.63 |

What is claimed is:

1. Apparatus comprising a stack, a fired heater for producing flue gases which are exhausted through the stack, and a damper assembly operatively associated with the stack at a longitudinal location in the stack to control draft in the stack, said damper assembly comprising a plurality of damper blades extending across a gas flow path for the stack at the longitudinal location in the stack, each damper blade of the plurality having a longitudinal axis, the longitudinal axes of all damper blades of the plurality being parallel to each other, each damper blade being at least partly rotatable around its longitudinal axis to regulate flue gas flow through the stack, and a plurality of operators operatively associated with the plurality of damper blades to effect rotational positioning of the blades, wherein the plurality of operators can be the same or different in number from the plurality of blades, at least one of said operators being decoupled from the rest of the plurality of operators and independently positioning at least one but not all of the plurality of damper blades, wherein the plurality of damper blades is at least three in number, and wherein the number of operators is at least two in number, wherein each operator is operatively coupled to an electronic controller, one controller per operator, for signaling the operator to set the blade position, wherein a major portion of the plurality of damper blades is set in a mostly closed position and a minor portion of the plurality of damper blades is set in a mostly open position, wherein the plurality of damper blades is four in number and the major portion is three and the minor portion is one.

* * * * *